United States Patent [19]

Van Mullekom

[11] 4,090,536

[45] May 23, 1978

[54] WEAVING LOOM COMPRISING A PNEUMATICALLY OPERATED STORAGE DEVICE

[75] Inventor: Hubert Peter Van Mullekom, Deurne, Netherlands

[73] Assignee: Ruti-Te Strake B.V., Deurne, Netherlands

[21] Appl. No.: 758,006

[22] Filed: Jan. 10, 1977

[30] Foreign Application Priority Data

Jan. 20, 1976 Netherlands ..... 7600569

[51] Int. Cl.[2] ..... D03D 47/34

[52] U.S. Cl. ..... 139/452

[58] Field of Search ..... 139/435, 452; 226/97, 226/118; 66/125, 132

[56] References Cited

U.S. PATENT DOCUMENTS

| | | | |
|---|---|---|---|
| 3,482,606 | 12/1969 | Mizuno et al. | 139/452 |
| 3,665,974 | 5/1972 | Barten | 139/435 |
| 3,736,964 | 6/1973 | Budzyna | 139/452 |
| 3,865,149 | 2/1975 | Keldany | 139/452 |

*Primary Examiner*—Henry S. Jaudon
*Attorney, Agent, or Firm*—Marshall & Yeasting

[57] ABSTRACT

A loom comprising a continuously operable weft yarn supply mechanism and an intermittently operable weft inserting mechanism. A tubular storage device is provided having a substantially constant shape in cross-section from one end to the other and storing weft yarn between said mechanisms, the stored yarn being in the shape of a loop having substantially parallel legs. The storage tube is in a substantially upright position and has a common entrance and exit at its lower end, said loop opening downwardly toward said lower storage device end. A suction nozzle is connected to the upper end of the storage device, and a blowing nozzle is adjacent said lower storage device end to propel weft yarn upwardly in a floating condition into the storage device, the suction nozzle helping to keep the weft yarn in such floating condition and sucking fluff away from the lower end of the storage device and discharging it.

3 Claims, 1 Drawing Figure

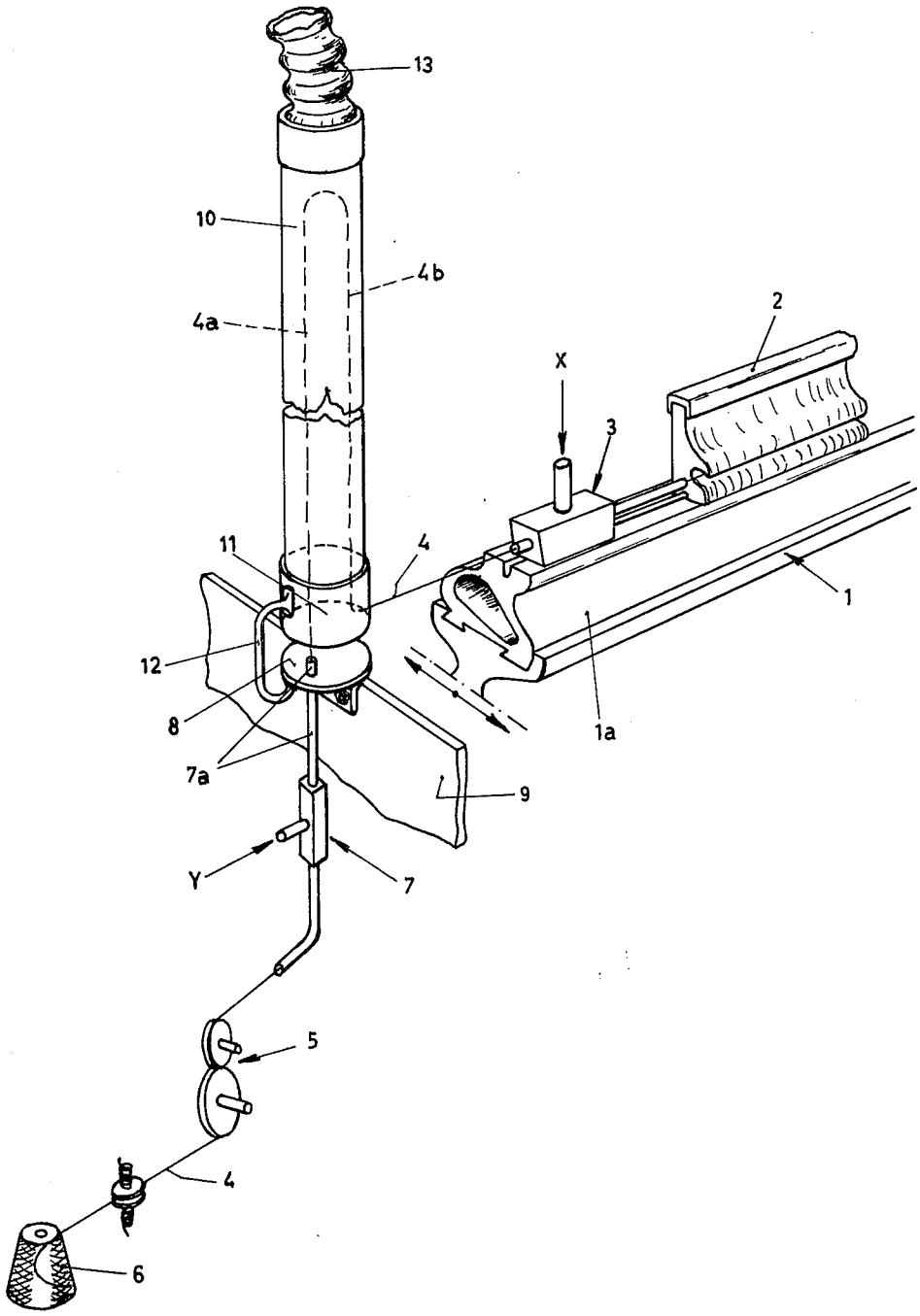
13
10
4b
4a
2
X
3
11
4
1
12
8
1a
7a
9
Y
7
5
4
6

WEAVING LOOM COMPRISING A PNEUMATICALLY OPERATED STORAGE DEVICE

The invention relates to a loom comprising a substantially tubular storage device located between a continuously operable weft yarn supply mechanism and an intermittently operable weft inserting mechanism. The storage device has a substantially constant shape in cross-section from one end to the other and stores weft yarn between the mechanisms. The stored yarn is in the shape of an open loop having substantially parallel legs means are provided for generating an air stream within the storage device including a blowing nozzle positioned adjacent the entrance to the storage device in the path of the ingoing leg of an yarn loop, and a section nozzle connected to the storage device at a location remote from the entrance.

A known storage device of this type is formed mainly by a flat tube. The flat shape of the storage device restricts the freedom of movement and thereby suppresses the tendency of the loop legs to become entangled. However, this involves friction of the yarn along the closely opposed storage tube walls. The friction is overcome by the air flow generated by a suction nozzle.

In another known storage device, the flat tube of the device above referred to is replaced by a shield extending only on one side of the loop. The blowing nozzle being therein the only air flow generating means cooperating with the storage device. In this embodiment the suction nozzle is not needed because the yarn is not guided, between two closely opposed storage tube walls and therefore no or at least much less friction of the yarn along said walls has to be overcome. The advantage of this embodiment is that the downstream loop leg — at least in the inoperative period of the weft inserting device — is practically without tension. This means that when the yarn loop length kept in storage is intermittently used, involving imparting certain acceleration forces to the downstream loop leg in order to ensure weft insertion within a predetermined short period, substantially no opposing forces are met. The tensions in the weft yarn during the insertion thereof are thereby kept relative low.

The storage tube of the invention is in a substantially upright position and has a common entrance and exit at its lower end and stores the weft yarn in the shape of a loop having substantially parallel legs. The loop opens downwardly toward the lower storage device end. A suction nozzle is connected to the upper end of the storage device and a blowing nozzle is located adjacent the lower storage end to propel weft yarn upwardly in a floating condition into the storage device. The suction nozzle helps to keep the weft yarn in such floating condition and sucks fluff away from the lower end of the storage device and discharges it.

In the storage device according to the invention; the yarn therefore is not contained between two closely opposed storage tube walls so that the yarn movement into and from the tube is substantially not braked by friction along the walls. The upright position of the storage tube contributes to this. The upward air flow comes from all sides at the lower end of the storage tube together with this air the fluff gathered in the vicinity of the entrance opening of the tube is efficiently sucked off. This means that the weft yarn is cleaned during storage whereby defects in functioning during weaving, e.g., by fluff deposit on the warp yarns, blocking of the weft blowing nozzles and the like, are avoided. The air flow is substantially less powerful than in the prior flat tubular shape; further contributing to keeping the yarn in a floating condition within the tube. In floating condition the yarn loop may be readily (i.e., substantially tensionless) supplemented at the side of the ingoing leg and intermittently consumed at the side of the outgoing leg. Also, the upright position of the storage tube is highly advantageous in connection with the space used by the storage device.

In the preferred embodiment the storage tube has a circular cross-section.

The storage device according to the invention is particularly suitable for application in a loom of the type in which the main blowing nozzle is mounted to more together with the reed. In such a loom the outgoing yarn loop leg may adjust itself each time to the momentary position of the reed by sliding along the lower edge of the storage tube so that the weft yarn each time extends along the shortest distance from the storage tube to the main blowing nozzle or to a yarn clamp provided in front of the entrance thereof, respectively.

BRIEF DESCRIPTION OF THE DRAWING

The drawing shows a perspective view of a loom provided with a storage device according to the invention.

Part of the reed movable in the direction of the double arrow is indicated by the reference number 1. The lamellae 2 therein define in known manner a conveying tunnel through which the weft yarn is conveyed through the weaving shed. The weft inserting device is mounted on the lay beam l*a* and includes a blowing nozzle 3 supplied with air according to the arrow X. The nozzle 3 has its outlet end positioned in front of and facing in the longitudinal direction of the said conveying tunnel.

The weft yarn 4 is drawn by means of continuously rotating measuring rollers 5 from a stationary yarn package 6. The weft yarn supplied by the measuring rollers 5 is supplied to the blowing nozzle 7 which has its outlet opening 7*a* directed upwardly. The outlet end 7*a* projects through an aperture at the edge of a substantially horizontally disposed disc 8 secured to the weaving loom frame 9.

Directly over the disc 8 a storage tube 10 having a circular cross-section is provided of a transparent plastic material and is mounted with its lower end in a ring member 11. The ring member 11 is secured to the disc 8 by means of a bracket 12, a circumferential gap being left free between said disc and the lower edge of the ring member 11. A connection hose 13 is connected to the upper end of the tube 10 extending to a vacuum source.

In operation yarn is continuously carried upwardly in a floating condition by the blowing nozzle 7, along the ingoing yarn loop leg 4*a* in the storage tube 10. Intermittently, i.e., each time at the start of a weft determined by the opening of a conventional yarn clamp arranged adjacent to the main blowing nozzle 3 and not shown in the drawing, a predetermined yarn length is taken by the main blowing nozzle 3 according to the outgoing leg 4*b* from the storage tube 10 and conveyed through the weaving shed. Apart from the upward air stream concentrated adjacent to and around the ingoing yarn loop leg 4*a* there is an upward air suction flow (vacuum hose 13) filling the storage tube completely, which suction flow contributes to keeping the yarn loop in floating condition and, moreover, sucks fluff through the circumferential gap at the lower end of the storage tube from the vicinity of the storage tube and discharges it.

I claim:

1. A loom comprising a continuously operable weft yarn supply mechanism and an intermittently operable weft inserting mechanism, wherein the improvement comprises a tubular storage device having a substantially constant shape in cross-section from one end to the other and storing weft yarn between said mechanisms, the stored yarn being in the shape of a loop having substantially parallel legs, the storage device being in a substantially upright position and having a common entrance and exit at its lower end, said loop opening downwardly toward said lower storage device end, a suction nozzle connected to the upper end of the storage device, and a blowing nozzle adjacent said lower storage device end to propel weft yarn upwardly in a floating condition into the storage device, the suction nozzle helping to keep the weft yarn in such floating condition and sucking fluff away from the lower end of the storage device and discharging it.

2. A loom according to claim 1 wherein a member is located below said lower storage device end to define a gap through which one of said legs of the loop exits.

3. A loom according to claim 2 wherein the tubular storage device has a circular cross-section.

* * * * *